US006145511A

United States Patent [19]

Teufel et al.

[11] Patent Number: 6,145,511

[45] Date of Patent: Nov. 14, 2000

[54] FILTER CIGARETTE

[75] Inventors: Eberhard Teufel, Gundelfinger; Wolfgang Sexauer, Merzhausen; Rolf Willmund, Ermendingen, all of Germany

[73] Assignee: Rhodia Acetow AG, Freiburg, Germany

[21] Appl. No.: 09/068,191

[22] PCT Filed: Oct. 31, 1996

[86] PCT No.: PCT/EP96/04733

§ 371 Date: May 4, 1998

§ 102(e) Date: May 4, 1998

[87] PCT Pub. No.: WO97/16986

PCT Pub. Date: May 15, 1997

[30] Foreign Application Priority Data

Nov. 9, 1995 [DE] Germany ..... 195 41 873

[51] Int. Cl.[7] ..... A24D 3/04; A24D 3/08; A24D 3/14

[52] U.S. Cl. ..... 131/334; 131/331; 131/332; 131/343; 131/345

[58] Field of Search ..... 131/331, 332, 131/334, 343, 345

[56] References Cited

U.S. PATENT DOCUMENTS

| | | | |
|---|---|---|---|
| 4,620,554 | 11/1986 | Horimoto | 131/331 |
| 5,275,859 | 1/1994 | Phillips et al. | 131/332 |
| 5,465,739 | 11/1995 | Perfetti et al. | 131/332 |
| 5,746,231 | 5/1998 | Lesser et al. | 131/331 |

FOREIGN PATENT DOCUMENTS

91/12737 9/1991 WIPO .

*Primary Examiner*—Stanley S. Silverman
*Assistant Examiner*—Michael P. Colaianni
*Attorney, Agent, or Firm*—Bucknam and Archer

[57] ABSTRACT

A description is given of a filter cigarette, whose filter a) contains fibrous filter material, b) contains an additive with an antimutagenic action on the cigarette smoke in a quantity of less than 15 wt. %, based on the fiber weight of the filter and c) on smoking a similar unventilated filter cigarette, but not containing additive, has a nicotine retention $R_N$ (in %) (determined according to CORESTA recommended method No. 9) satisfying the following formula:

$$R_N \geqq 100*(1-D)$$

in which:

$$D=\exp(A*B+C),$$

with $$A=21 \text{ mm}-\text{filter length (mm) for filter lengths} \leqq 25 \text{ mm or}$$

$$A=-4 \text{ mm for filter lengths} > 25 \text{ mm},$$

$$B=9.3*10^{-3}(1/\text{mm}) \text{ and}$$

$$C=-(d^4*\Delta p*K+L)$$

with d=filter diameter (mm), $\Delta p$=draw resistance of filter (mm hydraulic pressure), $K=1.0228*10^{-6}$ $(1/(\text{mm}^4*\text{mm hydraulic pressure}))$ and

L=0.2334.

Using said filter and measured according to the Ames test with strain TA 98, it is possible to filter mutagenically acting substances with a selectivity of at least 10% better than other smoke ingredients. A particularly suitable method for the manufacture of such a filter cigarette is described.

19 Claims, No Drawings

FILTER CIGARETTE

The invention relates to a filter cigarette, whose filter contains an additive with an antimutagenic action on the cigarette smoke.

Antimutagenic substances are known from food technology. In the latter numerous mutagens occurring in foods, as well as their deposition mechanisms have been investigated and described (cf. inter alia P. Grasso, C.O.'Hare, Chemical Carcinogens ACS Monograph (Ch.E. Searle ed.), American Chemical Society, Washington, 1976, pp 700–728). The most active mutagens in foods are nowadays considered to be certain pyrolysis products of proteins, such as the compounds Tr-P1, Tr-P2, Glu-P1, Glu-P2 and also IQ (cf. inter alia K. Wakabayashi, M. Nagao, H. Esumi, T. Sugimura; Cancer Research, 52, 1992, pp 2092–2098). In mutagenicity tests, such as the Ames test well known to the experts (Ames et al, Methods vor Detecting Carcinogens and Mutagens with the Salmonella/Mammalian-Microsome Mutagenicity Test., Mutat. Res. 31, pp 347–364 and C. Smith et al.; Mutation Research 279, 1992, pp 61–73), these mutagens reveal an extremely high mutagenic potential. In living organisms such compounds can be clearly highly efficiently bound in the aqueous phase to constituents of usually plant or vegetable foods and are consequently effectively removed from the metabolism as water-insoluble complex compounds. As such antimutagenically acting substances are inter alia described chlorophyllin, hemin and derivatives related thereto (cf. i.a. R. Dashwood, D. Gno; Environmental and Molecular Mutagenesis, 22, 193, pp 166–171, S. Arimoto, H. Hayatsu; Mutation Research, 213, 1989, pp 217–226, and Kato et al, Mutation Research, 246, 1991, pp 169–178).

The mutagenic action of cigarette smoke, determined by the Ames test, is generally known to experts. However, what is unclear and disputed is to what substance group the mutagenic action of cigarette smoke can be effectively attributed. Thus, reference has been made in this connection to polycyclic, aromatic hydrocarbons and various nitrosamines (cf. i.a. E. L. Wynder and D. Hoffmann; "Smoking and Lung Cancer: Challenges and Opportunities", Cancer Research 54, p 5284 (1994), although certain working groups have been clearly able to show that, with regards to the action in the Ames test, their mutagenic potential in cigarette smoke can be ignored, because the concentrations in which such substances occur in the smoke of commercially available cigarettes are much too low to explain the effects described in standard mutagenicity tests. Although still under discussion among the experts, there is increasing evidence that the activity of smoke condensates in the Ames test (TA 98 and TA 100) can mainly be attributed to the formation of polycyclic, aromatic amines when burning tobacco (cf. inter alia R. S. Lake et al: "Fresh whole smoke mutagenicity assay with YG salmonella strains", paper read at the 48 Tobacco Chemists' Research Conference, Sep. 25–28, 1994, and M. Mitsuko et al. Jpn. J. Cancer, Res., 77, 1986, pp 419–422).

A large number of publications propose the use of the most varied additives for the specific reduction of certain smoke ingredients. German patent 1 300 854 describes the use of acidic carboxy alkyl ester as crosslinking and strengthening agents. On the disclosure of this patent are based numerous other publications concerning the use of organic acids as a filter additive, in order to specifically increase nicotine retention. The special feature of this idea is that the additive simultaneously acts as a plasticizer and consequently industrial production of the filter is readily possible. However, German patent 1 300 854 provides no information as to how mutagenic substances could be removed from cigarette smoke. The same applies with regards to the teaching of DE-OS 43 20 348, which also relates to the use of organic acids as a filter additive.

The effectiveness of the filter additives described in German patent 1 300 854 in a filter tow were established on such a filter tow with a filament titre of more than 3 dtex. However, no details are provided in either German patent 1 300 854 or DE-OS 43 20 384 on a possible reduction of the biological activity of cigarette smoke in the Ames test.

DE-OS 25 27 234, JP 50-125100 and JP 51-32799 describe the use of cyclodextrin, particularly β-cyclodextrin for more particularly filtering nicotine. This additive can be applied directly to cellulose acetate filters or as granules in chamber filters. However, the quantities described are extremely high, namely 30 to 80 mg per filter according to the two Japanese applications and "mainly or exclusively" according to DE-OS 25 27 234. No details are given on a possible reduction of the biological activity of smoke.

U.S. Pat. No. 5,409,021 describes a cigarette filter as a double or triple chamber filter, in which the chamber contains lignin as the filler. The quantities of active lignin given in the examples are between 22 and 66 mg. The known filter is effective relative to nicotine, benzpyrene, CO, metals and tobacco-specific nitrosamines. No reference is made to the reduction of the biological activity according to the Ames test (TA 98). The additive quantities used are approximately 20 to 50% of the filter fibre weight.

EP-A-493 026 describes the impregnation of a cellulose acetate filter with a N,N'-bis(3-triethoxysilyl-propyl) thiocarbamide monomer in concentrations of 6 to 15%. The measure U.S. Pat. No. 5,275,859, EP-A-346 648, WO-A-91/12737 and WO-A-87/00734 in connection with nicotine retention deal with the incorporation of additives into filter materials. These documents do not provide information on the diameter of the filter material and/or the tobacco mixture used, respectively. These quantities have a strong influence on nicotine retention. Thus, the known teachings cannot be reworked in such a way that a direct comparison with the subsequently described filter cigarette according to the invention is made possible.

(amended new page 3a; to insert on page 4, line 9ff.) leads to an increased filter activity with respect to polycyclic aromatics, metals and tobacco-specific nitro-samines. No information is given on the retention of the filter used. No details are given of the biological activity of the smoke in the Ames test (TA 98).

Russian patent 2 010 546 describes a combination of the teachings of EP-A-0 493 026 and U.S. Pat. No. 5,409,021.

JP-5-23159 describes a cigarette filter with ellagic acid as the additive and reference is also made to the antimutagenic action thereof. Additive quantities of 1 to 10 mg per filter are recommended. The antimutagenic action thereof according to the Ames test (TA 98) has not been proved.

EP-A-0 246 330 describes the reduction of the mutagenicity in the Ames test (TA 98) by activated cellulose powder, cellulose ion exchangers or hemin-doped celluloses in powder form. The examples exclusively describe chamber filters. The powder quantity used in order to obtain a specific mutagenicity reduction of more than 10% is well above 15%, based on the filter fibre weight used. It must also be possible to strew the additive between the acetate fibres or a monofilter. No further details are given on the effectiveness of this measure. Tests have shown that only with an additive quantity well above 10 mg per filter is it possible to achieve an action of more than 10% in the Ames test (TA 98).

On the basis of the aforementioned prior art, the problem of the invention is to propose a filter cigarette of the aforementioned type, in which the tobacco smoke is filtered in such a way that, measured according to the Ames test with strain TA 98, mutagenically acting substances are filtered with a selectivity of at least 10%, particularly more than 20%, better than other smoke ingredients. The invention also proposes a particularly suitable method for applying the additive to the filter.

According to the invention this problem is solved by a filter cigarette, whose filter contains an additive with an antimutagenic action on the cigarette smoke, in which the filter a) contains fibrous filter material, b) contains the additive in a quantity of less than 15 wt. %, based on the fibre weight of the filter and c) on smoking a similar unventilated filter cigarette, but non containing additive, has a nicotine retention $R_N$ (in %) (determined according to CORESTA recommended method No. 9), satisfies the following formula:

$$R_N \geqq 100*(1-D)$$

in which:

$$D=\exp(A*B+C),$$

with

A=21 mm−filter length (mm) for filter lengths≦25 mm or

A=−4 mm for filter lengths>25 mm, $B=9.3*10^{-3}$(1/mm) and $C=-(d^4*\Delta p*K+L)$ with d=filter diameter (mm), Δp=draw resistance of filter (mm hydraulic pressure), $K=1.0228*10^{-6}$ (1/(mm$^4$*mm hydraulic pressure)) and

L=0.2334.

As has already been stated, the filter construction is of decisive importance. It has surprisingly been found that for the effectiveness of the inventive measures it is necessary to have a minimum retention which is scarcely achieved in filters of existing commercially available cigarettes. Within the scope of the present application, the nicotine retention is used as a directional quantity for the retention.

The filtration capacity of a cigarette filter, besides being dependent on the material characteristics of the filter material, depends on the dimensions of the filter, such as the diameter and filter length, and the pressure drop in the filter (in the cigarette industry the term draw resistance is used for designating the pressure drop).

The necessary filtration capacity of a cigarette and in particular the nicotine retention can be expressed by the following, empirically determined equation:

$$R_N \geqq 100*(1-D)$$

in which $R_N$ represents the nicotine retention (in %) and D the nicotine permeability of the filter. The permeability of a filter relative to nicotine can be gathered from the following equation:

$$D=\exp(A*B+C),$$

in which the variable A describes the dependence of the filtration capacity on the filter length. The variable A is calculated by subtracting the filter length l from the length of a King Size filter $l_o$:

$$A=l_o-l,$$

in which l=filter length in mm and $l_o$=21 mm=length of King Size filter.

As it was surprisingly found that for solving the problem according to the invention in the case of filter lengths over 25 mm there was no need to increase the minimum retention in accordance with the growing filter length, in the case of filter lengths over 25 mm a value for A of −4 mm is used.

B is a constant determined as:

$$B=9.3*10^{-3}(1/\text{mm})$$

The variable C describes the dependence of the filtration capacity on the diameter and draw resistance:

$$C=-(d^4*\Delta p*K+L),$$

with d=filter diameter (mm)

Δp=draw resistance of filter (mm hydraulic pressure)

$K=1.0228*10^{-6}$ (1/(mm$^4$*mm hydraulic pressure))

L=0.2334, in which constants K and L represent material constants determined in accordance with the above values for fixing the minimum retention.

With regards to smoking for the determination of the minimum retention, use is made of the CORESTA monitor cigarette No. 2 (cf. Coresta Approved Monitor No. 2 (CM2) of borgwaldt technik, D-22525 Hamburg). However, as this product is only defined for one diameter, for other cigarette diameters use was made of tobacco rods of identical tobacco (flue cured), rod papier, casing and tobacco density. As the nicotine retention is independent of the rod dimensions and the nicotine retention of cigarette filters when using flue cured tobaccos is identical with the condensate retention (G. Lipp: Beiträge zur Tabakforschung 3, 109 (1965)), the procedure for the determination of the retention is not critical.

The nature of the fibrous filter material used in the filter cigarettes according to the invention is not critical. Said materials can e.g. be fibres of polypropylene, viscose, polyester and in particular cellulose materials. Cellulose acetate is particularly preferred. Fibrous filter materials can be used in the form of a filter tow or a nonwoven fabric. It is particularly advantageous to use a cellulose acetate filter tow. If a nonwoven is used, the latter preferably comprises a paper, but it is also possible to use nonwovens of highly fibrillated cellulose fibres or so-called melt-blown nonwovens and spunbonded nonwovens. In the case of a cellulose acetate filter tow, the latter preferably contains staple fibres and/or filaments with a titre of less than 3 dtex, particularly of 1.0 to 2.7 dtex. A particularly good filtering action is obtained in this case.

The desired filtering action is also increased by ventilating the filter. For further information on a filter reference is made to EP-B-0 368 065. It is known from the latter that in ventilated cigarettes, there is an increasing deposition of volatile, especially steam-volatile substances, with an increasing degree of ventilation. In the present invention a degree of ventilation of at least 15%, particularly 20 to 70% is advantageous.

Within the scope of the invention, the additive is present in the filter cigarette in a quantity of less than 15 wt. %, based on the filter fibre weight. This low proportion is surprising and is only possible due to the special filter construction, which is a characteristic of the inventive filter cigarette. This value can be further significantly reduced in the case of an advantageous choice of additives. Thus, it is possible and advantageous if the additive is present in a quantity of less than 10 wt. %, particularly less than 7 wt. %, based on the filter fibre weight. The minimum value is approximately 0.5 wt. %, based on the filter fibre weight. Different groups of compounds can be used with particular advantage and act in a selectively filtering manner relative to pyrolysis products of amino acids or proteins. These include compound Tr-P1, etc. explained hereinbefore in conjunction with food technology. This relates in particular to a) an additive in the form of an acid, an acid salt of an acid and/or an acid carboxyl ester, b) an additive in the form of a macromolecular, hydrophilic, organic compound with internal cavities for the complex binding in of low molecular weight substances, c) an additive in the form of phenolic compounds and/or d) an additive in the form of a complexing agent for low molecular weight substances. These compound groups include: group a): acid citric esters (these compounds simultaneously act as a plasticizer for cellulose acetate and can consequently be readily applied via the plasticizer dosing or metering, preferably mixed with other plasticizers), suberic acid, acid maleic, fumaric and/or adipic esters, particularly in alkyl acid ester forms, preference being given to methyl and ethyl esters, b) an additive in the form of polysaccharides and/or oligosaccharides, particularly in the form of activated celluloses and starch derivatives and/or cyclodextrin, β-cyclodextrin being particularly preferred, and in the form of a native protein, particularly β-lactoglobulin, c) an additive in the form of ellagic acid and/or lignin and d) an additive in the form of a metal complex of porphyrins, as are structurally known from hemoglobin or chlorophyll or vitamin $B_{12}$, chlorophyllin having proved to be particularly effective, because it dissolves sufficiently well in triacetin, in order to apply the same during filter manufacture in an effective quantity via plasticizer dosing. Of particular advantage among the aforementioned polyphenols are rapidly available lignin types with good solubility in triacetin and other plasticizers for cellulose acetate. This leads to a problem-free application of the additive during standard filter manufacturing processes.

It is also advantageous for solving the problem of the invention to use tobacco mixtures during cigarette manufacture which have a particularly low protein content. This measure reduces the formation of mutagenic substances.

The filter cigarettes according to the invention can be manufactured according to conventional methods. However, it is preferable for the additive to be applied to the filter, produced from a fibrous filter material, particularly in the form of cellulose acetate, mixed with a plasticizer, particularly in the form of glycerin triacetate, during a conventional filter rod manufacture.

The invention leads to the following advantages: The chosen filtration concept makes it possible to obtain the requisite effects with a minimum additive use. In addition, an optimization is possible on choosing additives from the specified substance groups in order to improve the filtering effect. This advantage is based on the finding that a particular target group of mutagenically acting substances must be selectively filtered. The effects proved in the Ames test can be fully verified in cell cultures of higher organisms, such as the hamster cell test of cell culture V79. This clearly stresses the relevance of the present invention in connection with the health and smoking questions. Another important advantage of the invention is that a particularly appropriate method for the industrial manufacture of the filters is given, which can be implemented without any significant modification to existing technologies.

The invention is further illustrated by means of the following example.

EXAMPLE

The fibrous filter material was based on a filter tow of cellulose-2,5-acetate of different specifications. The significance of the filter tow specifications used can be gathered from the brochure "Die Qualität um Rhodia Filter Tow" of September 1994, published by the Technical Customer Servicing Department of Rhodia Filtertow of Rhône-Poulenc Rhodia AG, Freiburg, Germany. The abbreviations "SK" and "HK" are designations with respect to the crimp index used exclusively the Filter tow department of RHÔNE-POULENC. The filters were manufactured on a filter rod machine KDF2 with a rod part AF 2 of Körber AG (Hauni-Werke), Hamburg, Germany. The filter rod dimensions were 7.8×120 mm. The filter wrapper paper used was a paper with the designation F 796-28 of Julius Glatz, Papierfabriken, Neidenfels, Germany. The additive was applied mixed with triacetin by means of plasticizier dosing. The additives used were citric diethyl ester (CDE) (Boehringer Mannheim GmbH, Chemische Fabrik, Mannheim, Germany, art. 663502) and lignin (lignin-organosolv of Aldrich-Chemie, Steinheim, Germany, art. 37, 101–7). Plasticizer determination took place by the differential weighing of filter rods with and without plasticizer. The additive coating was calculated on the basis of the plasticizer coating and the plasticizer concentration in triacetin. The following table I gives details of the filter rods produced:

TABLE I

| Sample designation | Titre | Draw resistance (mm hydraulic pressure) | Fibre weight (mg) | Plasticizer coating (%) | Additive type and quantity (%) |
|---|---|---|---|---|---|
| A1.5 | 1.5 Y 30 SK | 462 | 530 | 6.9 | — |
| A3.0 | 3.0 Y 35 HK | 412 | 663 | 7.8 | — |
| A8.0 | 8.0 Y 35 HK | 182 | 638 | 7.9 | — |
| B1.5-1 | 1.5 Y 30 SK | 452 | 527 | 8.4 | 2.6 CDE |
| B1.5-2 | 1.5 Y 30 SK | 465 | 527 | 13.9 | 4.3 CDE |
| B3.0 | 3.0 Y 35 HK | 422 | 667 | 8.3 | 2.5 CDE |
| B8.0 | 8.0 Y 35 HK | 174 | 636 | 8.0 | 2.4 CDE |
| C1.5 | 1.5 Y 30 SK | 457 | 521 | 13.8 | 1.0 lignin |
| C3.0 | 3.0 Y 35 HK | 421 | 665 | 13.9 | 1.0 lignin |
| C8.0 | 8.0 Y 35 HK | 186 | 651 | 13.2 | 1.0 lignin |

Note: The details in table I under the column "titre" mean: first figure titre in denier of a filament and second figure titre in denier of the filter tow divided by 1000, "Y" standing for the cross-sectional shape of the filament.

The filter rods were cut to a length of 20 mm and bonded to the tobacco rod of a CORESTA monitor cigarette and smoked according to the CORESTA recommended method No. 22 and 23. Nicotine determination and nicotine retention determination took place according to CORESTA recommended method No. 7 and 9. The draw resistances of the cut-to-length filters (length=20 mm) are related to the draw resistance values of the filter rods (length=120 mm) given in table I in the ratio of the cut length to the original length.

The mutagenic action of the condensates was tested by means of the Ames test (Maron, Dorothy M. and Ames, Bruce N., Revised Methods for the Salmonella mutagenicity test, Mutation Research, 113 (1983) 173–215, taking account of the general framework conditions described in the OECD Guideline for Testing of Chemicals No. 471 of May 26, 1983). All tests took place with the bacterial strain TA 98 with metabolic activation. Condensate was obtained for the Ames test according to CORESTA standards 22 and 23. Since, on smoking the test cigarettes, due to the unequal filter activities of the test filters, different condensate quantities occurred, the condensate solutions were brought to the same concentration by dilution, in order to provide information on the specific, i.e. condensate quantity-independent mutagenicity. The extraction of the smoked Cambridge filter and dilution was carried out as follows. The Cambridge filter was extracted in 50 ml of ethanol p.A. for 60 minutes, accompanied by shaking in an Erlenmeyer flask. An aliquot part of the solution is removed and its extinction determined UV-spectroscopically at a wavelength of 310 nm. The original condensate solution is then diluted in such a way that purely mathematically it has an extinction of 2.0. This corresponds to a moist condensate concentration, as a function of the moisture and nicotine content of the moist condensate, of approximately 4 mg/ml of ethanol. Aliquot parts (5, 10, 20, 30, 40, 50 $\mu$l) of this solution are then used in Ames test TA 98. There is generally a linear dose-action relationship in the range 5 to 50 $\mu$l, so that the reduction of the mutagenicity at a specific condensate solution quantity can be evaluated. The values given in the following table II concerning the reduction of the mutagenicity (% reduction in the Ames test) were determined for a condensate solution quantity of 40 $\mu$l. The number of revertants with test cigarette A3.0 serves as a reference and was fixed at 100%. In the final column of table II, negative values correspond to a reduced mutagenicity compared therewith and positive values to an increased mutagenicity compared therewith.

The following table II summarizes the smoking values and results:

TABLE II

| Sample | mg nicotine | mg condensate | % nicotine retention | 100 * (1-D) according to equation (I) | (%) reduction in Ames test |
|---|---|---|---|---|---|
| A1.5 | 0.65 | 11.7 | 47.2 | 40.3 | +2 |
| A3.0 | 0.74 | 13.4 | 37.5 | 38.4 | 0 |
| A8.0 | 0.94 | 16.4 | 25.1 | 28.7 | −8 |
| B1.5-1* | 0.56 | 11.8 | 56.4 | — | −44 |
| B1.5-2* | 0.52 | 11.4 | 59.0 | — | −62 |
| B3.0 | 0.64 | 13.5 | 50.4 | — | −10 |
| B8.0 | 0.82 | 16.9 | 36.6 | — | +5 |
| C1.5* | 0.68 | 11.7 | 47.3 | — | −40 |
| C3.0 | 0.77 | 13.5 | 40.1 | — | −3 |
| C8.0 | 0.99 | 16.3 | 24.7 | — | +8 |

*example according to the invention

It can be gathered from the example that by an increase in the additive quantity there is also a rise in the antimutagenic action (cf. particularly sample B1.5-2) but that the additive quantity used is very small compared with the known filters with additives. This means that, according to the present invention, a very high mutagenicity reduction is achieved with relatively small additive quantities. The values of the measured nicotine retention for samples B and C have merely an illustrative function. In particular, samples B reveal that, in accordance with the teaching of German patent 1 300 854, nicotine retention is significantly increased by the citric diethyl ester.

What is claimed is:

1. A cigarette filter containing an additive having an antimutagenic action on cigarette smoke, said filter comprising:

a) a fibrous filter material; and b) an antimutagenic acting additive added to said fibrous filter material in a quantity less than 15 wt. % based on the fiber weight of the filter, wherein said filter, when part of an unventilated filter cigarette having the tobacco strand of CORESTA monitor cigarette No. 2, but said filter cigarette having no filter additive, has a nicotine retention $R_n$ (in %), determined according to CORESTA recommended method No. 9, satisfying the following formula when smoked:

$$R_N \geqq 100*(1-D)$$

in which:

$$D=\exp(A*B+C),$$

with $A$=21 mm−filter length (mm) for filter lengths≦25 mm or $A$=−4 mm for filter lengths>25 mm, $B=9.3*10^{-3}$(1/mm) and $C=-(d^4*\Delta p*K+L)$ with d=filter diameter (mm), $\Delta p$=draw resistance of filter (mm hydraulic pressure), $K=1.0228*10^{-6}$ (1/(mm$^4$*mm hydraulic pressure)) and $L$=0.2334.

2. The cigarette filter according to claim 1, characterized in that the nicotine retention $R_N$ of the filter without additive is at least 2% points, preferably at least 5% points higher than 100*(1−D).

3. The cigarette filter according to claim 1, characterized in that the additive is present in a quantity of less than 10 wt. %, particularly less than 7 wt. %, based on the fibre weight of the filter.

4. The cigarette filter according to claim 1, characterized in that the filter contains as fibrous filter material a cellulose acetate filter tow, which consists of staple fibres and/or filaments with a titre of less than 3 dtex, particularly of 1.0 to 2.7 dtex.

5. The cigarette filter according to claim 1, characterized in that the filter is ventilated.

6. The cigarette filter according to claim 5, characterized in that the filter comprises a degree of ventilation of at least 15%, particularly 20 to 70%.

7. The cigarette filter according claim 1, characterized in that the additive is an acid, an acid salt of an acid and/or an acid carboxyl ester.

8. The cigarette filter according to claim 7, characterized in that the additive is present in the form of suberic acid, an acid citric, maleic, fumaric and/or adipic ester.

9. The cigarette filter according claim 1, characterized in that the additive is present in the form of a macromolecular, hydrophilic, organic compound with internal cavities for the complex binding in of low molecular weight substances.

10. The cigarette filter according to claim 9, characterized in that the additive is present in the form of polysaccharides and/or oligosaccharides.

11. The cigarette filter according to claim 10, characterized in that the additive is present in the form of starch and/or cyclodextrin, particularly in the form of β-cyclodextrin.

12. The cigarette filter according to claim 9, characterized in that the additive is present in the form of a protein.

13. The cigarette filter according to claim 1, characterized in that the additive is present in the form of a phenolic compound.

14. The cigarette filter according to claim 13, characterized in that the additive is present in the form of ellagic acid and/or lignin.

15. The cigarette filter according to claim 1, characterized in that the additive is present in the form of a complexing agent for low molecular weight substances.

16. The cigarette filter according to claim 15, characterized in that the additive is present in the form of a metal complex of a porphyrin.

17. The cigarette filter according to claim 1, characterized in that the additive is applied mixed with a plasticizer, particularly in the form of glycerol triacetate, to the fibrous filter material.

18. The cigarette filter according to claim 1, characterized in that the filter is part of a double or multiple filter construction.

19. Method for the manufacture of a filter cigarette according to claim 1, characterized in that the additive is applied to the filter, manufactured from a fibrous filter material, particularly in the form of cellulose acetate, mixed with a plasticizer, particularly in the form of glycerol triacetate, in conventional filter rod manufacture.

* * * * *